United States Patent [19]

Yamane et al.

[11] Patent Number: 4,800,013

[45] Date of Patent: Jan. 24, 1989

[54] REFRIGERATOR OIL COMPOSITION

[75] Inventors: Ryozo Yamane, Funabashi; Takashi Kurihara, Ichihara; Hiroshi Kaise, Ouizumi; Takeo Komatsubara, Ashikaga; Takashi Sunaga, Oura, all of Japan

[73] Assignee: Idemitsu Kosan Company Limited, Tokyo, Japan

[21] Appl. No.: 50,501

[22] Filed: May 13, 1987

[30] Foreign Application Priority Data

May 26, 1986 [JP] Japan ..... 61-119090

[51] Int. Cl.[4] ..... C10G 71/00

[52] U.S. Cl. ..... 208/19; 208/14; 208/18; 585/1; 585/6.6

[58] Field of Search ..... 208/14, 18, 19; 585/1, 585/6.6

[56] References Cited

U.S. PATENT DOCUMENTS

| | | | |
|---|---|---|---|
| 2,436,565 | 2/1948 | Gillett | 208/19 |
| 2,816,867 | 12/1957 | Moore | 208/19 |
| 2,900,322 | 8/1959 | Zoeller | 208/19 |
| 3,640,868 | 2/1972 | Rocchini et al. | 208/14 |
| 3,715,302 | 2/1973 | Mills et al. | 208/14 |
| 3,759,817 | 9/1973 | Mills et al. | 208/14 |
| 3,791,959 | 2/1974 | Mills et al. | 208/19 |
| 3,904,507 | 9/1975 | Mills | 208/19 |
| 3,912,617 | 10/1975 | Mills | 208/19 |
| 3,915,871 | 10/1975 | Bryer et al. | 208/19 |
| 3,928,168 | 12/1975 | Mills et al. | 208/19 |
| 4,072,620 | 2/1978 | Masungu et al. | 208/19 |
| 4,082,866 | 4/1978 | Link | 208/19 |
| 4,213,845 | 7/1980 | Masada | 208/19 |
| 4,218,305 | 8/1980 | Gannon et al. | 208/19 |
| 4,324,933 | 4/1982 | Kimura et al. | 208/14 |
| 4,427,561 | 1/1984 | Kusayanagi et al. | 252/45 |
| 4,442,027 | 4/1984 | Sato | 208/14 |

FOREIGN PATENT DOCUMENTS

| | | |
|---|---|---|
| 55-44119 | 11/1980 | Japan . |
| 57-8294 | 1/1982 | Japan . |
| 60-1357 | 1/1985 | Japan . |

*Primary Examiner*—H. M. S. Sneed
*Assistant Examiner*—Helane Myers
*Attorney, Agent, or Firm*—Frishauf, Holtz, Goodman & Woodward

[57] ABSTRACT

The present invention relates to a refrigerator oil composition which comprises 70 to 98 wt % of a paraffin base oil having a pour point of not more than −35° C., a sulfur content of not more than 50 ppm (parts per million), and a kinematic viscosity at 40° C. of 5 to 500 cSt (centistrokes) and 30 to 2 wt % of a naphthene base oil having a pour point of not more than −35° C., a sulfur content of 0.05 to 1 wt % and a kinematic viscosity at 40° C. of 5 to 500 cSt, and in which the sulfur content is 0.01 to 0.10 wt %.

The refrigerator oil composition of the present invention effectively prevents the formation of valve sludge. The refrigerator oil composition of the present invention is also excellent in anti-wear properties. Furthermore the refrigerator oil composition of the present invention is excellent in stability and baking resistance in the condition that is in contact with the refrigerant (Furon) and further is excellent in low temperature solubility. Moreover the refrigerator oil machine oil composition of the present invention contains as a main component a paraffin base oil which is steadily available.

4 Claims, No Drawings

REFRIGERATOR OIL COMPOSITION

BACKGROUND OF THE INVENTION

The present invention relates to a refrigerator oil composition. More particularly it is concerned with a refrigerator oil composition which prevents formation of valve sludge and is excellent in anti-wear properties, and further which is excellent in stability in the presence of refrigerants (Furon), anti-seizure properties and low temperature solubility. Thus the conposition of the present invention is useful for lubrication of refrigerators for air conditioning, freezing and so forth.

For a refrigerator oil for use in lubrication of sliding parts of refrigerating machines such as a room air conditioner, a car air conditioner, a car cooler and a refrigerator is required to be excellent in stability in the presence of refrigrants, anti-seizure properties and low temperature solubility, to be free from formation of valve sludge, and further to be excellent in anti-wear properties.

As a refrigerator oil to meet the above requirements, Japanese Patent Publication No. 44119/1980 discloses a composition composed of a naphthene base oil and a paraffin base oil. This composition, however, has a disadvantage in that the naphthene base oil to be used as a main component is not easily available because of a shortage of a naphthene base crude oil. On the other hand, a paraffin base oil is steadily available, but is poor in stability and low temperature solubility in the condition that is in contact with a refrigerant.

In view of the above problem, it has been proposed to improve the anti-wear properties in the condition that is in contact with a refrigerant, by adjusting the total sulfur content of a refrigerator oil. Japanese Patent Application Laid-Open No. 8294/1982, for example, discloses a refrigerating machine oil composition in which the total sulfur content is adjusted to not less than 0.14 wt % to improve properties such as anti-wear properties. Japanese Patent Publication No. 1357/1985 discloses a refrigerator oil composition in which a base oil composed mainly of alkylbenzene is used and the total sulfur content is adjusted to a specified range in relation to viscosity.

The above refrigerator oils, however, still have problems such as formation of valve sludge and low anti-wear properties in their practical use.

SUMMARY OF THE INVENTION

The present invention is intended to overcome the above problems, and an object of the present invention is to provide a refrigerator oil composition which prevents formation of valve sludge, is excellent in anti-wear properties and further which is excellent in stability, anti-seizure properties and low temperature solubility in the condition that is in contact with a refrigerant.

It has been found that the object can be attained by using a composition comprising a paraffin base oil having specified properties as a base component, with a naphthene base oil having specified properties compounded thereto, and adjusted in sulfur content to a specified range.

The present invention relates to a refrigerator oil composition which comprise 70 to 98 wt % of a paraffin base oil having a pour point of not more than −35° C., a sulfur content of not more than 50 ppm (parts per million), and a kinematic viscosity at 40° C. of 5 to 500 cSt (centistokes) and 30 to 2 wt % of a naphthene base oil having a pour point of not more than −35° C., a sulfur content of 0.05 to 1 wt % and a kinematic viscosity at 40° C. of 5 to 500 cSt, and in which the sulfur content is 0.01 to 0.10 wt %.

DETAILED DESCRIPTION OF THE INVENTION

The paraffin base oil which is used as the main component of the refrigerator oil composition of the present invention has the following properties. That is, the pour point (determined according to JIS K-2269) is not more than −35° C. and preferably not more than −40° C.; the sulfur content is not more than 50 ppm and preferably not more than 30 ppm; and the kinematic viscosity at 40° C. is 5 to 500 cSt and particularly preferably 6 to 30 cSt in that the energy needed in operation of a refrigerator can be saved. If the pour point is more than −35° C., the refrigerator oil does not work smoothly when used at a very low temperature. If the sulfur content is in excess of 50 ppm, the stability in the atmosphere of Furon is undesirably reduced. If the kinematic viscosity at 40° C. is less than 5 cSt, the anti-seizure properties is seriously reduced and thus the refrigerator becomes impossible to operate. On the other hand, if the kinematic viscosity at 40° C. is in excess of 500 cSt, the energy loss due to viscosity resistance is undesirably increased.

The paraffin base oil can be obtained by purifying a distilled oil (having a boiling point of 250° to 450° C. under atmospheric pressure) resulting from distillation of a paraffin crude oil by the usual procedure and then subjecting it to deep-dewaxing treatment.

The distilled oil means an oil as obtained by distilling under atmospheric pressure a crude oil or by distilling under reduced pressure a residual oil resulting from distillation under atmospheric pressure of a crude oil.

The method of purification of the distilled oil is not critical; that is, the distilled oil can be purified by any of the following methods (1) to (5).

Treatment (1): the distilled oil is hydrogenated, or is subjected to alkali treatment and/or sulfuric acid treatment after hydrogenation.

Treatment (2): the distilled oil is subjected to solvent extracting, or is subjected to alkali treatment and/or sulfuric acid treatment after solvent extracting.

Treatment (3): the distilled oil is hydrogenated and subsequently is subjected to the second stage hydrogenation treatment.

Treatment (4): the distilled oil is hydrogenated and then is subjected to the second stage hydrogenation treatment and further to the third stage hydrogenation treatment.

Treatment (5): the distilled oil is hydrogenated and then is subjected to the second hydrogenation treatment and further to alkali distillation and/or sulfuric acid treatment.

One of the treatments is described below in detail.

A distilled oil is prepared from a paraffin crude oil or an intermediate crude oil by the usual method. This distilled oil is subjected to a severe hydrogenation treatment i.e., hydro treating process. In this treatment, undesiratle components for the lubricant oil fraction, that is, an aromatic component and so forth are removed or changed into useful components. In this treatment, sulfur and nitrogen components are almost removed.

Subsequently, fractional distillation such as distillation under reduced pressure is carried out so that the necessary viscosity can be obtained. Thereafter, the known solvent dewaxing is carried out to such an extent that the pour point reaches that of the usual paraffin base oil, i.e., −15° C. to −10° C.

After this dewaxing treatment, if desired, a hydrogenation treatment is further applied to hydrogenate or saturate the major portion of the aromatic fraction, thereby increasing the thermal and chemical stability of the base oil.

The oil thus obtained, however, is unsuitable as a refrigerator oil because its pour point is still high. For this reason, deep-dewaxing treatment is successively applied. For this treatment, the solvent dewaxing method under severe conditions or the catalytic hydrogenation dewaxing method in which a Zeolite catalyst is used and paraffin (mainly n-paraffin) adsorbed in pores of the catalyst is selectively decomposed in the atmosphere of hydrogen to remove the paraffin which is to constitute a wax fraction is employed.

The hydrogenation treatment is usually carried out under such conditions that the reaction temperature is 200° to 480° C. and preferably 250° to 450° C., the hydrogen pressure is 5 to 300 kilograms per square centimeter ($kg/cm^2$) and preferably 30 to 250 $kg/cm^2$, and the amount of hydrogen introduced (per 1 killoliter of the distilled oil supplied) is 30 to 3,000 $Nm^3$ (normal cubic meter) and preferably 100 to 2,000 $Nm^3$. The catalyst to be used for this purpose is prepared by depositing a catalyst component selected from Groups VI and VIII metals, preferably cobalt, nickel, molybdenum and tungsten on a carrier such as alumina, silica, silica.alumina, zeolite, active charcoal and bauxite by conventional methods. It is preferred for the catalyst to be preliminarily sulfurized prior to its use.

As described above, the is subjected to various treatments after the above hydrogenation treatment. In a case where the second or third hydrogenation treatment is applied, the hydrogenation conditions are determined within the above specified ranges. Hydrogenation conditions in the first, second and third hydrogenation treatments may be the same or different. Usually, however, the hydrogenation treatment is carried out in such a manner that the conditions for the second hydrogenation treatment are more severe than those for the first hydrogenation treatment and the conditions for the third hydrogenation treatment are more severe than those for the second hydrogenation treatment.

The alkali treatment is carried out for the purpose of removing small amounts of the acidic substances, thereby improving the stability of the distilled ingredient. This alkali treatment is conducted by distillation under reduced pressure in the presence of an alkaline substance such as NaOH, KOH and the like.

The sulfuric acid treatment is generally carried out as a finishing step for the petroleum product; that is, this sulfuric acid treatment is applied for the purpose of improving the properties of the distilled oil by removing the aromatic hydrocarbons, particularly the polycyclic aromatic hydrocarbons, olefins, sulfur compounds and the like. In the present invention, concentrated sulfuric acid is added to the above treated oil in an amount of 0.5 to 5% by weight based on the weight of the treated oil, and the sulfuric acid treatment is carried out at a temperature of room temperature to 60° C. Thereafter the sulfuric acid is neutralized with NaOH and the like.

In the present invention, as described above, the distilled oil is treated by the treatments (1) to (5). Of these treatments, the treatments (1), (3) and (4) are suitable.

The paraffin base oil having the above properties can be obtained by the treatment as described above. Preferably used in the present invention is a paraffin base oil which is subjected to clay treatment.

The other component to be used in the present invention is a naphthene base oil. This naphthene base oil has a sulfur content of 0.05 to 1 wt %, preferably 0.2 to 0.6 wt %, a pour point (as determined according to JIS K-2269) of not more than −35° C., preferably not more than −40° C., and a kinematic viscosity at 40° C. of 5 to 500 cSt and particularly preferably from a standpoint of saving the amount of energy in operation of the refrigerator, a kinematic viscosity at 40° C. of 6 to 30 cSt. If the sulfur content is less than 0.05 wt %, a refrigerator oil having the desired properties cannot be obtained. On the other hand, if the sulfur content is in excess of 1 wt %, the stability in the condition that is in contact with the refrigerant is undesirably reduced.

The above naphthene base oil is not critical in the method of preparation thereof. Preferably used in the present invention is a naphthene base oil which is subjected to solvent extraction by the usual method and then to hydrogenation treatment, clay treatment and so forth.

The refrigerator oil composition of the present invention is composed of 70 to 98 wt %, preferably 80 to 95 wt % of the paraffin base oil having the above specified properties and 30 to 2 wt %, preferably 20 to 5 wt % of the naphthene base oil having the above specified properties. If the proportion of the paraffin base oil is in excess of 98 wt %, the formation of valve sludge cannot be prevented and the anti-wear properties are undesirably reduced.

The sulfur content of the composition of the present invention must be in the range of 0.01 to 0.10 wt %, with the range of 0.02 to 0.06 wt % being particularly preferred. It is preferred for the usual lubricating oil to be reduced in sulfur content as much as possible, because a lubricating part is exposed to air. This is not applicable to the refrigerator oil composition of the present invention which is to be used in lubrication of a sliding part of the refrigerator. That is, if the sulfur content of the composition is less than 0.01 wt %, the formation of valve sludge readily occurs and the anti-wear properties are undesirably reduced. On the other hand, if the sulfur content of the composition is in excess of 0.10 wt %, the formation of valve sludge occurs particularly readily. It is essential, therefore, that the sulfur content of the composition be in the range of 0.01 to 0.10 wt %.

It is to be noted that even if the sulfur content of the composition is within the above specified range, when the proportions of the paraffin and naphthene base oils are not within the above specified ranges, the formation of valve sludge cannot be prevented and the objects of the present invention cannot be attained.

It is preferred, as described above, that the paraffin and naphthene base oils be each subjected to clay treatment. It is also possible that the two base oils be mixed and then subjected to clay treatment.

In connection with the composition of the present invention, it suffices that the sulfur content is within the above specified range. Although the pour point and kinematic viscosity at 40° C. of the composition are not critical, the pour point is usually not more than −35° C.

and preferably not more than −40° C., and the kinematic viscosity at 40° C. is 5 to 500 cSt and preferably 6 to 30 cSt.

The refrigerator oil composition of the present invention effectively prevents the formation of valve sludge. The refrigerator oil composition of the present invention is also excellent in anti-wear properties. Furthermore the refrigerator oil composition of the present invention is excellent in stability and anti-seizure properties in the condition that is in contact with the refrigerant (Furon) and further is excellent in low temperature solubility. Moreover the refrigerator oil machine oil composition of the present invention contains as a main component a paraffin base oil which is steadily available.

Accordingly the refrigerator oil composition of the present invention can be effectively used in lubrication of sliding parts of refrigerators such as a room air conditioner, a car air conditioner, a car cooler and a refrigerator.

The present invention is described in greater detail with reference to the following examples.

Preparation Example

Production of Paraffin Base Oil

A Kwait crude oil was subjected to distillation under atmospheric pressure followed by distillation under reduced pressure, and the distilled oil and residual oil thus obtained were subjected to deasphalting. The fraction thus obtained was hydrogenated under such severe conditions as to produce a dewaxed oil product (i.e., an oil product subjected to the first dewaxing treatment) having a viscosity index of 100.

The above oil product was fractionated to obtain a wax-containing oil having a viscosity at 100° C. of 2.3 cSt.

This wax-containing oil was subjected to solvent dewaxing treatment under such conditions that the pour point of the resulting dewaxed oil was −15° C.

Then the above dewaxed oil was further hydrogenated under such conditions that the aromatic content (n-d-M method) was not more than 1.5 wt %.

The above secondary hydrogenation treatment oil was subjected to solvent dewaxing treatment under such conditions that the pour point was −40° C., and then was subjected to clay treatment to obtain a paraffin base oil (I).

A paraffin base oil (II) was obtained in the same manner as in the paraffin base oil (I) except that the secondary hydrogenation treatment was not applied.

Properties of the paraffin base oils (I) and (II), and of a comparative paraffin base oil (III) are shown in Table 1.

TABLE 1

| | Paraffin Base Oil (I) | Paraffin Base Oil (II) | Paraffin Base Oil (III) |
|---|---|---|---|
| Kinematic Viscosity (cSt) | | | |
| 40° C. | 9.2 | 9.0 | 20.5 |
| 100° C. | 2.4 | 2.3 | 4.0 |
| Pour Point*1 (°C.) | −45 | −45 | −20 |
| Sulfur Content*2 (ppm) | 3 | 25 | 1500 |
| % Ca (n-d-M method) | 0 | 13.0 | 4.0 |

*1Pour Point: Measured according to JIS K-2269
*2Sulfur Content: Measured by the coulometric titration method (according to ASTM D3120)

EXAMPLES 1 to 7

The paraffin base oil (I) obtained in Preparation Example and a naphthene base oil (I) subjected to hydrogenation treatment followed by clay treatment (sulfur content: 0.40 wt %; pour point: −50° C.; kinematic viscosity at 40° C.: 0.5 cSt; kinematic viscosity at 100° C.: 2.3 cSt) were compounded in the ratio shown in Table 2 to obtain a composition having the sulfur content shown in Table 2.

Each composition was evaluated by the testing methods shown below. The results are shown in Table 2.

Evaluation of Valve Sludge and Anti-Wear Properties

A refrigerator was operated under the conditions shown below to evaluate the oil composition.

(1) Conditions

Refrigerant:Furon (R-12)
Compressor: Reciprocompressor of 150 W
Discharge Temperature: 135°-140° C.
Testing Time: 500 hours (2) Evaluation Method After the operation, the amount of valve sludge at the discharge valve and the condition of wear of the sliding part were examined. The evaluation rating was as follows.

| | Valve Sludge | Anti-Wear Properties |
|---|---|---|
| A | Almost no sludge-like substance was observed. | Equal to the unoperated machine or worn only to an extent that the sliding part had somewhat luster. |
| B | Small amount of sludge-like substance was observed. | Sliding part had strong luster as a result of wear, but no streak-like scratches were observed. |
| C | Sludge-like substance was observed on the whole surface. | Small amount of shallow streak-like scratches were observed at the worn part. |
| D | Carbon sludge was observed in a deposited form. | Numerous shallow streak-like scratches were observed at the worn part. |

Seizure Load

Measured according to ASTM D3233. That is, after running-in operation for 5 minutes at an oil temperature of 30° C. and a load of 150 LBS, the baking load (LBS) was measured.

Sealed Tube Test 4 ml (milliliter) of a sample oil was introduced in a 10-ml pressure glass ampoule wherein steel, copper and aluminum wires were placed, by the use of a syringe, and then the air dissolved in the sample oil was removed. 2 g of a refrigerant, dichlorodifluoromethane (R-12), was introduced while cooling with liquid nitrogen. Then the ampoule was sealed by the use of a burner. The sealed ampoule was allowed to stand for 30 days on an oil bath maintained at 175° C. The ampoule was partially cracked, and the amount of R-22 formed (vol%) was measured.

Sealed Flock Test 0.4 g of an oil was introduced in a 10-ml pressure glass ampoule, and the pressure in the ampoule was decreased. 3.6 g of a coolant, dichlorodifluoromethane, was introduced while colling with liquid nitrogen, and then the ampoule was sealed by the use of a burner. The sealed ampoule was transferred to a low temperature bath and the temperature was lowered stepwise. At each temperature, the inside of the ampoule was examined. A temperature at which the flock appeared during the examination was referred to as a "flock point".

COMPARATIVE EXAMPLE 1

The procedure of Examples 1 to 7 was repeated with the exception that the naphthene base oil was not used. The results are shown in Table 2.

COMPARATIVE EXAMPLE 2

The procedure of Examples 1 to 7 was repeated with the exception that the ratio of the paraffin base oil (I) to the naphthene base oil (II) was changed as shown in Table 2. The results are shown in Table 2.

COMPARATIVE EXAMPLE 3

An oil composition on the market (sulfur content: 0.2 wt %) was evaluated in the same manner as in Examples 1 to 7. The results are shown in Table 2.

COMPARATIVE EXAMPLE 4

The paraffin base oils (I) and (III) obtained in Preparation Example were compounded in the ratio shown in Table 2 and then evaluated in the same manner as in Examples 1 to 7. The results are shown in Table 2.

COMPARATIVE EXAMPLE 5

A composition consisting of 50 wt % of the paraffin base oil (I) obtained in Preparation Example and 50 wt % of a naphthene base oil (II) (dynamic viscosity at 40° C.: 8.7 cSt; dynamic viscosity at 100° C.: 2.2 cSt; pour point: not more than −50° C.; sulfur content: 0.08 wt %) was evaluated in the same manner as in Examples 1 to 7. The results are shown in Table 2.

TABLE 2

| | Composition (wt %) | | | | Sulfur | Evaluation | | | | |
|---|---|---|---|---|---|---|---|---|---|---|
| | Paraffin Base Oil | | Naphthene Base Oil | | Content (wt %) | Valve Sludge | Anti-Wear Properties | Baking Load (LBS) | Sealed Tube Test (vol %) | Flock Point (°C.) |
| Comparative Example 1 | I | 100 | I | 0 | 0.0003 | C | C | 300 | 0.2 | −50≧ |
| Example 1 | I | 97.5 | I | 2.5 | 0.01 | B | A | 420 | 0.2 | — |
| Example 2 | I | 92.5 | I | 7.5 | 0.03 | A | A | 470 | 0.2 | −50≧ |
| Example 3 | I | 90 | I | 10 | 0.04 | A | A | 480 | 0.3 | −50≧ |
| Example 4 | I | 85 | I | 15 | 0.06 | B | A | 480 | 0.5 | — |
| Example 5 | I | 75 | I | 25 | 0.1 | B | A | 460 | 0.6 | — |
| Comparative Example 2 | I | 50 | I | 50 | 0.2 | D | A | 480 | 1.2 | — |
| Comparative Example 3 | Oil Composition on the market | | | | 0.2 | C | B | 480 | 0.9 | −50≧ |
| Example 6 | II | 92.5 | I | 7.5 | 0.03 | A | A | 480 | 0.3 | −50≧ |
| Example 7 | II | 90 | I | 10 | 0.04 | A | A | 480 | 0.3 | −50≧ |
| Comparative Example 4 | I | 80 | Paraffin Base Oil III | 20 | 0.03 | C | A | 480 | 1.4 | −35 |
| Comparative Example 5 | I | 50 | II | 50 | 0.04 | C | B | 460 | 2.2 | −50≧ |

What is claimed is:

1. A refrigerator oil composition comprising 70 to 98 wt % of a paraffin base oil having a pour point of not more than −35° C., a sulfur content of not more than 50 ppm and a kinematic viscosity at 40° C. of 5 to 500 cSt, and 30 to 2 wt % of a naphthene base oil having a pour point of not more than −35° C., a sulfur content of 0.05 to 1 wt % and a kinematic viscosity at 40° C. of 5 to 500 cSt, wherein the sulfur content of the composition is 0.01 to 0.10 wt %.

2. The refrigerator oil composition as claimed in claim 1 wherein the paraffin base oil has a pour point of not more than −40° C., a sulfur content of not more than 30 ppm and a kinematic viscosity at 40° C. of 6 to 30 cSt.

3. The refrigerator oil composition as claimed in claim 1 wherein the naphthene base oil has a pour point of not more than −40° C., a sulfur content of 0.2 to 0.6 wt % and a kinematic viscosity at 40° C. of 6 to 30 cSt.

4. The refrigerator oil composition as claimed in claim 1 wherein the sulfur content of the composition is 0.02 to 0.06 wt %.

* * * * *